United States Patent [19]

Omura

[11] Patent Number: 4,823,744

[45] Date of Patent: Apr. 25, 1989

[54] ROTATION SPEED CONTROL DEVICE FOR A HYDRAULICALLY OPERATED COOLING FAN OF AN INTERNAL COMBUSTION ENGINE

[75] Inventor: Seiji Omura, Toyota, Japan

[73] Assignee: Toyota Jidosha Kabushiki Kaisha, Aichi, Japan

[21] Appl. No.: 182,217

[22] Filed: Apr. 15, 1988

[30] Foreign Application Priority Data

Apr. 16, 1987 [JP] Japan ..... 62-058003[U]

[51] Int. Cl.[4] ..... F01P 7/02

[52] U.S. Cl. ..... 123/41.12

[58] Field of Search ..... 123/41.11, 41.12

[56] References Cited

U.S. PATENT DOCUMENTS 4,200,146 4/1980 Olson ..... 123/41.12 X
4,223,646 9/1980 Kinder ..... 123/41.12
4,446,697 5/1984 Goscenski Jr. ..... 123/41.12 X
4,479,532 10/1984 Watanabe ..... 123/41.12 X

*Primary Examiner*—Tony M. Argenbright
*Assistant Examiner*—Eric R. Carlberg
*Attorney, Agent, or Firm*—Kenyon & Kenyon

[57] ABSTRACT

A device for controlling the rotation speed of a cooling fan of an internal combustion engine in a vehicle such as an automobile, wherein the fan is driven by a hydraulic motor powered by an operating fluid supplied by a pump directly driven by the engine, wherein the device controls partial relief of the hydraulic fluid supplied from the pump toward the motor so that, in a low engine revolution speed range, the ratio of the partial relief is decreased as the engine temperature increases, but in a high engine revolution speed range, the ratio of the partial relief is increased as the engine revolution speed increases.

4 Claims, 2 Drawing Sheets

ROTATION SPEED CONTROL DEVICE FOR A HYDRAULICALLY OPERATED COOLING FAN OF AN INTERNAL COMBUSTION ENGINE

BACKGROUND OF THE INVENTION

1. Field of the invention

The present invention relates to a rotation speed control device for a cooling fan of an internal combustion engine in a vehicle such as an automobile, and particularly relates to a rotation speed control device for a hydraulically operated variable speed cooling fan of an internal combustion engine in a vehicle such as an automobile.

2. Description of the prior art

It is already well known in the art of an internal combustion engine in a vehicle such as an automobile to drive a cooling fan which supplies a flow of cold air to an engine cooling radiator by a hydraulic motor, and to control the rotation speed of such a motor according to the coolant temperature and other parameters, as is disclosed in, for example, Japanese Utility Model Publication No. Sho 49-40183 (1974) and Japanese Patent Laying Open Publication No. Sho. 58-13119 (1983).

3. Problem to be solved by the invention

The pump which supplies an operating fluid to the hydraulic motor is coupled to the output shaft of the internal combustion engine and is thus directly driven by the internal combustion engine. For this reason, when the internal combustion engine is operating at high speed the pump is also rotating at high speed and therefore the pressure within the pump is increased. When the pump is operated at high rotation speed under high pressure in this manner, its durability is reduced as compared with the operation at a low speed under the same pressure, and the pump noise is also increased.

SUMMARY OF THE INVENTION

The object of the present invention is to provide an improved rotation speed control device for a cooling fan of an internal combustion engine in a vehicle such as an automobile by solving the above problems.

The above object is accomplished, according to the present invention, by a rotation speed control device for a hydraulically operated cooling fan of an internal combustion engine in a vehicle such as an automobile, said fan being driven by a hydraulic motor which is operated by an operating fluid supplied from a pump drivingly coupled to and driven by an output shaft of the internal combustion engine, said hydraulic motor being controlled of the rotation speed thereof depending on the flow rate of the operating fluid supplied thereto, comprising a coolant temperature detection means which detects the temperature of a coolant for cooling the engine; and an engine rotation speed detection means which detects the rotation speed of the engine; characterized by a coolant temperature related fan control amount determination means which determines a coolant temperature related fan control amount so that the rotation speed of the cooling fan increases with an increase in coolant temperature; an engine rotation speed related fan control amount determination means which determines an engine rotation speed related fan control amount so that the rotation speed of the cooling fan decreases with an increase in engine revolution speed; a final fan control amount determination means which determines the rotation speed of the cooling fan based on either said coolant temperature related fan control amount or said engine rotation speed related fan control amount which provides a lower rotation speed of the cooling fan than the other; and a relief valve type flow control means which controls a first part of the operating fluid supplied from said pump toward said hydraulic motor and a second part of the operating fluid supplied from said pump toward a relief in a mutually complementary relationship depending on either said coolant temperature related fan control amount or said engine rotation speed related fan control amount determined by said final fan control amount determination means so that said first part is increased or decreased relative to said second part as either said coolant temperature related fan control amount or said engine rotation speed related fan control amount based on which said final fan control means determines the rotation speed of the cooling fan increases or decreases, respectively.

When the engine is operating at a high speed, the pump directly coupled thereto is driven at a correspondingly high speed, but it is generally not required that the cooling fan is also driven at a correspondingly high speed. Further, when the engine is operating at high speed the vehicle is generally travelling at high speed so that the draft from the motion of the vehicle is applied to the radiator. (Of course the vehicle speed is not always proportional to the engine revolution speed due to the incorporation of a speed change transmission. However, in the modern automobiles equipped with high powered engines, in the range of operation where the draft from the motion of the vehicle may be taken into account, the variation in the ration between the engine revolution speed and the vehicle speed due to the operation of the speed change transmission may be neglected.) Therefore, by controlling the pump for generating the hydraulic power for driving the engine cooling fan in a negative proportional rate according to the engine revolution speed in a high engine revolution speed range, as switched over from the control of said pump according to a positive proportional rate according to the engine temperature in a low engine revolution speed range, the control of the engine cooling fan is highly optimized as a whole, while restricting the maximum load imposed on the pump for generating the hydraulic power for driving the engine cooling fan within a deriable limit. It is to be noted that it is the ratio between the first part of the operating fluid supplied to the motor for driving the engine cooling fan and the second part of the operating fluid which was pumped up by the pump but relieved toward a drain without imposing any substantial load on the pump that is controlled in a negative rate according to the engine revolution speed when the engine is operating at high revolution speed. Even when the relief flow rate is increased, the pump flow rate itself is still high and an adequate flow of operating fluid is supplied to the motor for driving the engine cooling fan enough to maintain the engine temperature at a desired temperature. Thus, the pump durability can be improved and the pump noise can be reduced. Further, in this way the pump drive force is reduced and thus the fuel consumption can be reduced.

DESCRIPTION OF THE PREFERRED EMBODIMENT

The present invention will now be described in detail with reference to the accompanying drawings and in terms of an embodiment.

Figure 1:
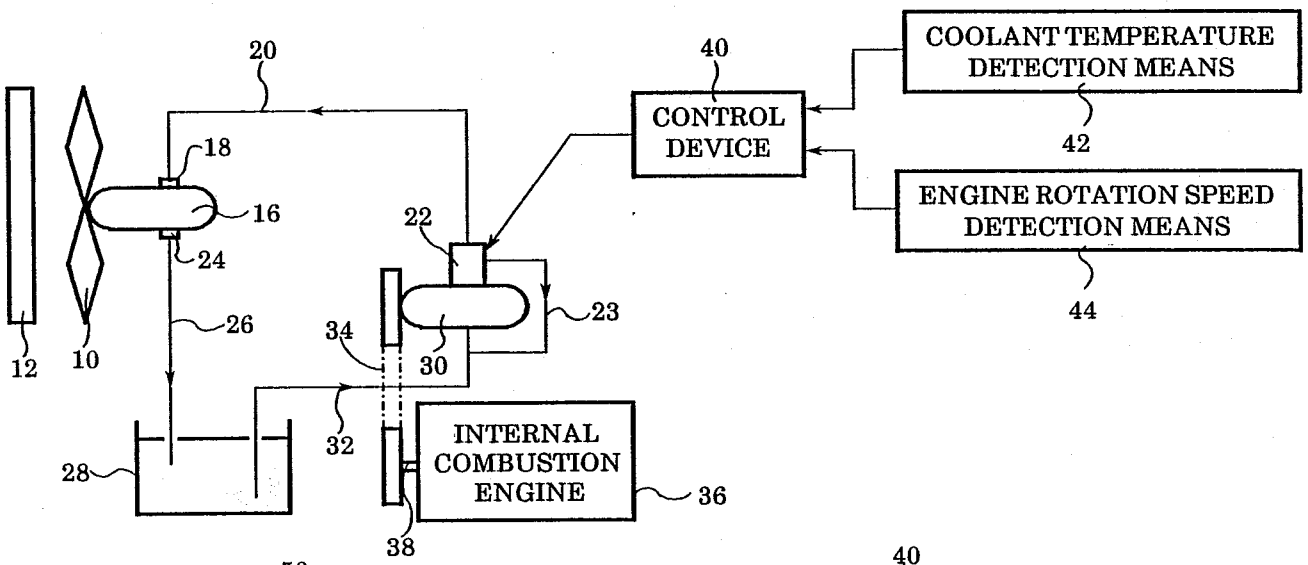
FIG. 1 is a schematic structural diagram showing one embodiment of a hydraulically operated cooling fan device provided with a rotation speed control device according to the present invention.

FIG. 1 shows an embodiment of a hydraulically operated cooling fan device provided with the cooling fan rotation speed control device according to the present invention. In the drawing, 10 is a cooling fan which supplies a cooling draft to an internal combustion engine radiator 12, and the cooling fan 12 is arranged to be rotatably driven by a hydraulic motor 16.

The hydraulic motor 16 is constructed so that its rotation speed increases with an increase in the flow rate of the operating fluid such as oil which is supplied to it, and has an operating fluid inlet 18 connected to a flow control valve 22 by means of a line 20, and an operating fluid outlet 24 connected to an operating fluid reservoir 28 by a line 26.

The flow control valve 22 is provided together with a pump 30. The pump 30 is drivingly coupled by a belt type transmission device 34 to an output shaft 38 of an internal combustion engine 36, and is directly rotatably driven by the engine 36. The pump 30 draws up the operating fluid from the reservoir 28 through a line 32, and pumps this to the flow control valve 22.

The flow control valve 22 is an electromagnetically operated type flow control valve which, depending on the duty factor of a pulse signal applied to its electromagnet activating portion, controls the flow rate of the operating fluid supplied to the hydraulic motor 16 and the flow rate of the hydraulic fluid returned to a relief passage 23, these two flow rates being in a complementary relationship. In this embodiment, the flow control valve 22 increases the flow rate of the operating fluid supplied to the hydraulic motor 16 and decreases the flow rate of the operating fluid toward the relief passage 23 as the duty factor of the pulse signal applied to the electromagnet activating portion is increased.

The duty factor of the pulse signal applied to the flow control valve 22 is controlled by an electrical control device 40.

Figure 2:
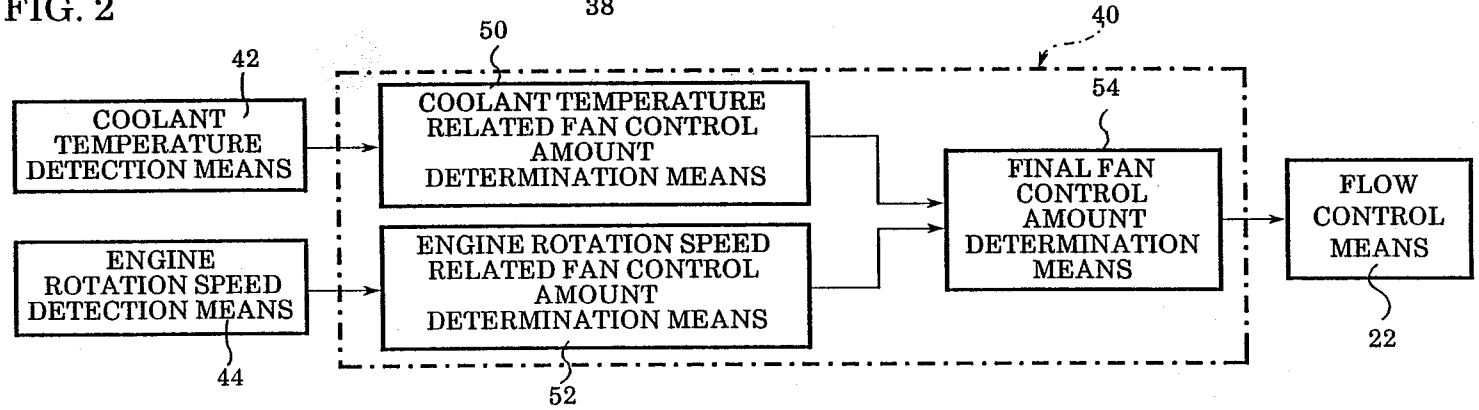
FIG. 2 is a block diagram showing one embodiment of a cooling fan rotation speed control device according to the present invention.

The control device 40 is supplied with information relating to the temperature of the coolant of the internal combustion engine 36 by a coolant temperature sensor 42, and information relating to the engine revolution speed of the engine 36 from an engine revolution speed sensor 44, and as shown in FIG. 2, has a coolant temperature related fan control amount determination means 50 which determines a fan control amount or in other words a duty factor so that the cooling fan rotation speed increases with an increase in the coolant temperature, an engine revolution rate related fan control amount determination means 52 which determines a fan control amount so that the cooling fan rotation speed decreases with an increase in the engine revolution speed, and a final fan control amount determination means 54 which determines as the final fan control amount a fan control amount based upon either the fan control amount determined by the coolant temperature related fan control amount determination means 50 or the fan control amount determined by the engine revolution speed related fan control amount determination means 52 so that the fan rotation speed is lower than controlled by one than controlled by the other, or in other words so that the relief flow rate of the operating fluid due to the flow control valve 22 is greater when controlled by one than controlled by the other, and the final fan control amount determination means 54 outputs a pulse signal of a duty factor based on the final fan control amount to the flow control valve 22.

Figure 3:
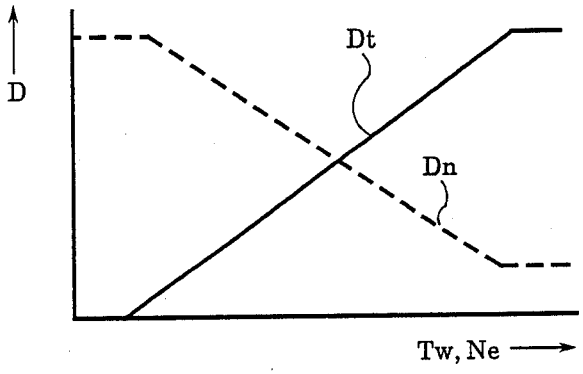
FIG. 3 is a graph showing fan control characteristics of the cooling fan rotation speed control device according to the present invention.

The coolant temperature related fan control amount determination means 50 is set so as to increase the fan control amount Dt according to an increase in the coolant temperature Tw as shown in FIG. 3.

The engine rotation speed related fan control amount determination means 52 is set to decrease the fan control amount Dn according to an increase in the engine revolution speed Ne as shown in FIG. 3.

Figure 4:
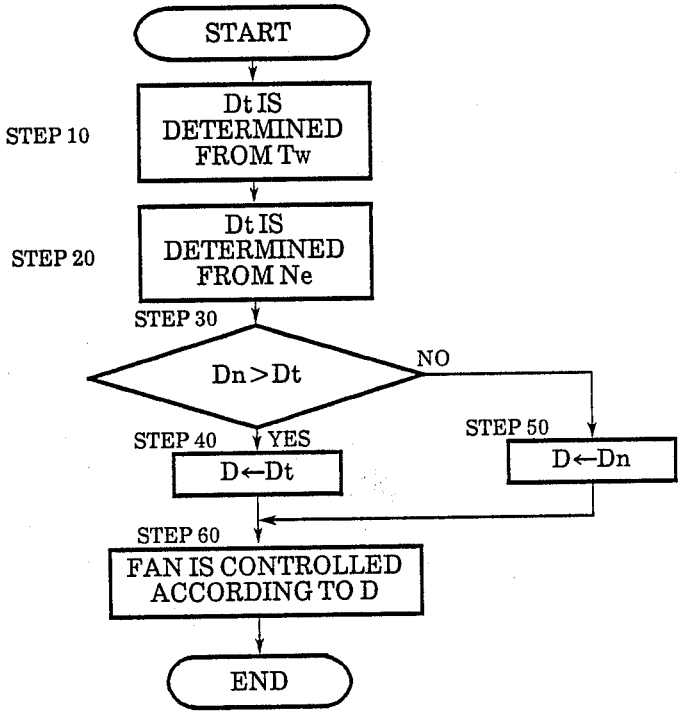
FIG. 4 is a flowchart showing an outline of control of the cooling fan rotation speed control device according to the present invention.

FIG. 4 is a flowchart showing an example of the operation of the cooling fan rotation speed control device according to the present invention. The control routine of the flowchart shown in FIG. 4 is executed repeatedly by time interrupts, and in the initial step 10 the fan control amount Dt is determined from the coolant temperature Tw detected by the coolant temperature sensor 42 according to the characteristics shown in FIG. 3. After step 10 the control proceeds to step 20.

In step 20, the fan control amount Dn is determined based on the engine revolution speed Ne detected by the engine revolution speed sensor 44 according to the characteristics shown in FIG. 3. After step 20, the control proceeds to step 30.

In step 30, a test is made as to whether or not the fan control amount Dt depending on the coolant temperature is less than the fan control amount Dn depending on the engine revolution speed Ne. If $Dn > Dt$ the control proceeds to step 40, whereas if not the control proceeds to step 50.

In step 40, the fan control amount Dt depending on the coolant temperature is determined as the final fan control amount D.

In step 50, the fan control amount Dn depending on the engine revolution speed is determined as the final fan control amount D.

After step 40 and step 50 the control proceeds to step 60, and in step 60, a pulse signal with a duty factor determined by the final fan control amount D is output to the flow control valve 22. Thus the flow control valve 22 controls the flow rate of the operating fluid provided to the hydraulic motor 16 and the flow rate of the operating fluid to the relief passage 25 in a mutually complementary relationship according to the duty factor. Thereby the cooling fan 10 is rotatably driven with a rotation speed depending on the duty factor, and any increase of the pressure within the pump 30 more than that which is necessary is avoided.

The present invention has been described above in detail with respect to a particular embodiment, but the present invention is not limited to this and it will be clear to those skilled in the relevant art that various embodiments are possible within the scope of the invention.

I claim:

1. A rotation speed control device for a hydraulically operated cooling fan of an internal combustion engine in a vehicle such as an automobile, said fan being driven by a hydraulic motor which is operated by an operating fluid supplied from a pump drivingly coupled to and driven by an output shaft of the internal combustion engine, said hydraulic motor being controlled by the rotation speed thereof depending on the flow rate of the operating fluid supplied thereto, comprising:

a coolant temperature detection means which detects the temperature of a coolant for cooling the engine;

an engine rotation speed detection means which detects the rotation speed of the engine;

a coolant temperature related fan control amount determination means which determines a coolant temperature related fan control amount so that the rotation speed of the cooling fan increases with an increase in coolant temperature;

an engine rotation speed related fan control amount determination means which determines an engine rotation speed related fan control amount so that the rotation speed of the cooling fan decreases with an increase in engine revolution speed;

a final fan control amount determination means which determines the rotation speed of the cooling fan based on either said coolant temperature related fan control amount or said engine rotation speed related fan control amount which provides a lower rotation speed of the cooling fan than the other; and a relief valve type flow control means which controls a first part of the operating fluid supplied from said pump toward said hydraulic motor and a second part of the operating fluid supplied from said pump toward a relief in a mutually complementary relationship depending on either said coolant temperature related fan control amount or said engine rotation speed related fan control amount determined by said final fan control amount determination means so that said first part is increased or decreased relative to said second part as either said coolant temperature related fan control amount or said engine rotation speed related fan control amount, based on which said final fan control means determines the rotation speed of the cooling fan, increases or decreases, respectively.

2. A rotation speed control device according to claim 1, wherein said coolant temperature related fan control amount determination means provides said coolant temperature related fan control amount as a first signal according to a scale of quantity and said engine rotation speed related fan control amount determination means provides said engine rotation speed related fan control amount as a second signal according to the same scale of quantity as said first signal, and said final fan control amount determination means compares the magnitudes of said first and second signals to make selection between said coolant temperature related fan control amount and said engine rotation speed related fan control amount for one of them which provides a lower rotation speed of the cooling fan than the other.

3. A rotation speed control device according to claim 1, wherein said coolant temperature related fan control amount determination means determines said coolant temperature related fan control amount so that it is increased substantially proportionally to the increase of coolant temperature up to a maximum value thereof.

4. A rotation speed control device according to claim 1, wherein said engine rotation speed related fan control amount determination means determines said engine rotation speed related fan control amount so that it is decreased from a maximum value thereof substantially proportionally to the increase of engine revolution speed.

* * * * *